US011255090B2

(12) United States Patent
Nygaard

(10) Patent No.: US 11,255,090 B2
(45) Date of Patent: Feb. 22, 2022

(54) CONNECTOR BRACKET FOR INTERCONNECTING ROOF WINDOWS, A ROOF WINDOW ARRANGEMENT, AND A METHOD FOR MOUNTING AT LEAST TWO WINDOWS IN AN INCLINED ROOF STRUCTURE

(71) Applicant: VKR Holding A/S, Hørsholm (DK)

(72) Inventor: Michael Nygaard, Odense (DK)

(73) Assignee: VKR Holding A/S

( * ) Notice: Subject to any disclaimer, the term of this patent is extended or adjusted under 35 U.S.C. 154(b) by 0 days.

(21) Appl. No.: 16/737,820

(22) Filed: Jan. 8, 2020

(65) Prior Publication Data

US 2020/0224420 A1 Jul. 16, 2020

(30) Foreign Application Priority Data

Jan. 10, 2019 (DK) ..... PA 2019 70013

(51) Int. Cl.
*E04D 13/03* (2006.01)
*E04D 13/035* (2006.01)

(52) U.S. Cl.
CPC ..... *E04D 13/031* (2013.01); *E04D 13/0351* (2013.01); *E04D 13/0354* (2013.01)

(58) Field of Classification Search
CPC ..... E04D 13/031; E04D 13/0351; E04D 13/0354; Y10T 403/32951; Y10T 403/32959

(Continued)

(56) References Cited

U.S. PATENT DOCUMENTS 2,056,444 A * 10/1936 Briggen ..... E04D 3/06 52/395
2,565,200 A * 8/1951 Burress ..... E04D 13/0351 49/208

(Continued)

FOREIGN PATENT DOCUMENTS

DE 7829553 1/1979
DE 7920893 11/1986

(Continued)

OTHER PUBLICATIONS

U.S. Appl. No. 16/737,802, filed Jan. 8, 2020 as entitled "A Middle Flashing Assembly and a Method for Weather-proofing a Roof Window Arrangement".

(Continued)

*Primary Examiner* — Brent W Herring
(74) *Attorney, Agent, or Firm* — Merek, Blackmon & Voorhees, LLC

(57) ABSTRACT

A connector bracket for interconnecting roof windows mounted adjacent to each other in an inclined roof structure, one roof window being located below the other roof window when seen in the direction of inclination of the roof structure, is disclosed. A first connecting section of the connector bracket extends in a first direction from a centre section of the connector bracket and is configured for being connected to the mounting bracket on the first roof window in a pivot connection. A second connecting section extends in a second direction from a centre section of the connector bracket and is configured for being connected to the mounting bracket on the second roof window in a fixed connection. The first and second directions are non-parallel. A roof window arrangement where roof windows are interconnected by such a connector bracket and a method for mounting at least two roof windows are also disclosed.

20 Claims, 6 Drawing Sheets

Figure 1:
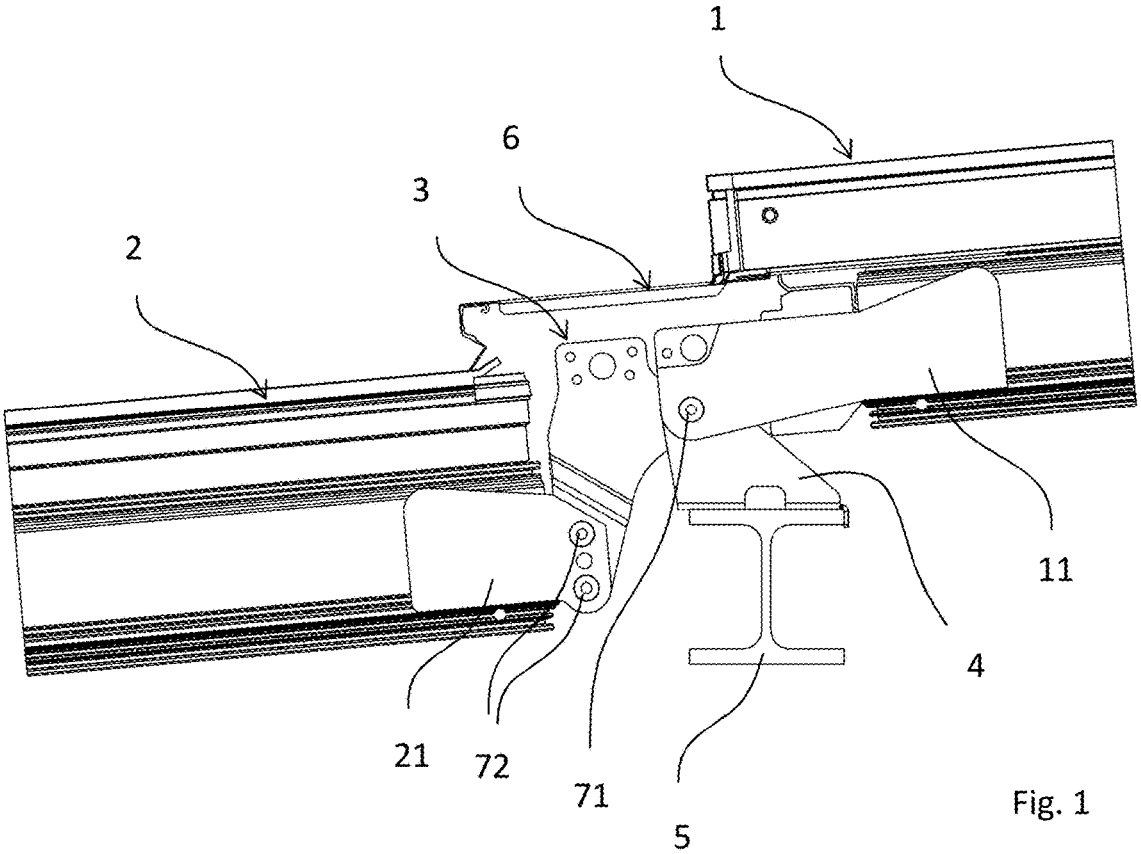

(58) Field of Classification Search
USPC ... 52/204.5, 204.51, 656.2, 656.5, 200, 518, 52/520, 543, 547, 556; 248/595, 278.1, 248/284.1, 291.1, 324, 208, 274.1, 276.1, 248/237; 403/75, 119; 47/17
See application file for complete search history.

(56) References Cited

U.S. PATENT DOCUMENTS

| | | | | |
|---|---|---|---|---|
| 3,001,331 | A * | 9/1961 | Brunton | F24S 20/67 52/518 |
| 3,771,277 | A * | 11/1973 | Rausch | F16B 5/0044 52/468 |
| 3,788,014 | A * | 1/1974 | Semisch | C01B 33/20 52/18 |
| 4,296,733 | A * | 10/1981 | Saunders | F24F 5/0046 126/619 |
| 4,327,532 | A * | 5/1982 | Matthews | E04D 3/08 52/200 |
| 4,426,812 | A * | 1/1984 | Pochter | A01G 9/1469 52/22 |
| 4,621,466 | A | 11/1986 | Sonneborn | |
| 7,658,356 | B1 | 2/2010 | Nehls | |
| 8,061,091 | B2 * | 11/2011 | Botkin | F24S 25/67 52/173.3 |
| 8,291,654 | B2 * | 10/2012 | Botkin | F24S 25/16 52/173.3 |
| 8,615,941 | B2 * | 12/2013 | Botkin | H02S 20/24 52/173.3 |
| 8,720,134 | B2 * | 5/2014 | Lindgren | E04D 13/0315 52/204.1 |
| 8,833,011 | B2 * | 9/2014 | Lindgren | E04D 13/031 52/204.57 |
| 9,140,050 | B2 * | 9/2015 | Lindgren | E06B 1/36 |
| 9,263,985 | B2 * | 2/2016 | Silberschatz | F24S 25/13 |
| 2007/0151594 | A1 * | 7/2007 | Mascolo | H02S 30/20 136/245 |
| 2008/0277551 | A1 * | 11/2008 | Hackney | E04B 7/045 248/276.1 |
| 2010/0089390 | A1 * | 4/2010 | Miros | F24S 25/16 126/608 |
| 2011/0277402 | A1 | 11/2011 | Schnitzer | |
| 2011/0278411 | A1 * | 11/2011 | Carbonare | F24S 25/16 248/237 |
| 2012/0048351 | A1 * | 3/2012 | Rizzo | F24S 25/16 136/251 |
| 2012/0167483 | A1 | 7/2012 | Lindgren et al. | |
| 2012/0167495 | A1 * | 7/2012 | Lindgren | E04D 13/031 52/200 |
| 2012/0167496 | A1 * | 7/2012 | Lindgren | E04D 13/031 52/204.1 |
| 2014/0083030 | A1 * | 3/2014 | Lindgren | E04D 13/0315 52/204.1 |
| 2014/0305046 | A1 | 10/2014 | Stearns et al. | |
| 2014/0366468 | A1 | 12/2014 | Lindgren et al. | |
| 2015/0267412 | A1 | 9/2015 | McClure | |
| 2016/0211793 | A1 * | 7/2016 | Grimmeisen | E04D 13/0351 |

FOREIGN PATENT DOCUMENTS

| | | |
|---|---|---|
| DE | 20206327 | 7/2002 |
| DE | 202012006688 | 10/2013 |
| DE | 202014000149 | 5/2014 |
| DK | 201670572 | 3/2018 |
| EP | 0087647 | 9/1983 |
| EP | 0428921 | 5/1991 |
| EP | 1533436 | 5/2005 |
| EP | 2472025 | 7/2012 |
| EP | 2472043 | 7/2012 |
| EP | 2752531 | 7/2014 |
| EP | 3039198 | 7/2016 |
| EP | 3252256 | 12/2017 |
| EP | 3282064 | 2/2018 |
| WO | WO 2004/055294 | 7/2004 |
| WO | WO2005/116365 | 12/2005 |
| WO | WO 2015/028032 | 3/2015 |
| WO | WO2015028030 | 3/2015 |

OTHER PUBLICATIONS

U.S. Appl. No. 16/737,811, filed Jan. 8, 2020 as entitled "An End Closure for a Cladding for a Roof Window and a Roof Window Arrangement".
U.S. Appl. No. 16/737,834, filed Jan. 8, 2020 as entitled "A Connector Element for a Flashing Assembly for use in a Roof Window Arrangement, and a Method for Weather Proofing a Roof Window Arrangement".
Danish Search Report issued in Danish Patent Application No. PA2019 70015 dated Jun. 6, 2019, four pages.
Danish Search Report issued in Danish Patent Application No. PA2019 70016 dated Aug. 27, 2019, four pages.
Danish Search Report issued in Danish Patent Application No. PA2019 70013 dated Jun. 28, 2019, four pages.
Danish Search Report issued in Danish Patent Application No. PA2019 70014 dated Jun. 25, 2019, four pages.
Machine generated translation of DE7829553.
Machine generated translation of DE202012006688.
Machine generated translation of DE7920893.
European Search Report dated May 25, 2020, 5 Pages Issued in Connection With European Application No. 20150912 Which is Related to U.S. Appl. No. 16/737,802.
European Extended Search Report dated Jun. 16, 2020, 5 Pages Issued in Connection With European Application No. 20150914 Which is Related to U.S. Appl. No. 16/737,811.
European Extended Search Report dated Apr. 23, 2020, 8 Pages Issued in Connection With European Application No. 20150910 Which is Related to U.S. Appl. No. 16/737,820.
European Extended Search Report dated May 29, 2020, 8 Pages Issued in Connection With European Application No. 20150909 Which is Related to U.S. Appl. No. 16/737,834.
Machine generated translation of DE202014000149.
Extended European Search Report dated Apr. 23, 2020 issued in connection with corresponding European Application No. 20150910, eight (8) pages.

* cited by examiner

CONNECTOR BRACKET FOR INTERCONNECTING ROOF WINDOWS, A ROOF WINDOW ARRANGEMENT, AND A METHOD FOR MOUNTING AT LEAST TWO WINDOWS IN AN INCLINED ROOF STRUCTURE

A connector bracket for interconnecting roof windows, a roof window arrangement, and a method for mounting at least two roof windows in an inclined roof structure The present invention relates to a connector bracket for interconnecting roof windows mounted adjacent to each other in an inclined roof structure, one roof window being located below the other roof window when seen in the direction of inclination of the roof structure. The invention further relates to a roof window arrangement for use in an inclined roof structure, and to a method for mounting at least two roof windows in an inclined roof structure, one below the other when seen in the direction of inclination of the roof structure.

In buildings where it is desired to have a large daylight opening in the roof structure, one or a few roof windows may not suffice and several roof windows can then be mounted in a group, closely side-by-side and/or above each other. The need for achieving a proper attachment of the roof windows to the load-bearing structure of the roof structure, however, necessitate a certain minimum distance between the windows of the group in order to give room for mounting brackets. Moreover, a flashing assembly including cladding, covering and flashing members is needed in order to achieve a proper draining of rain and melt water so that water does not penetrate into the roof structure, and this typically involves drainage gutters between the roof windows.

Large daylight admitting areas in roof structures can also be achieved by the use of glass panels with comparatively simple frames resembling those used in green houses and where panels are typically overlapping so that water drains off one panel and directly onto the other. Such panel structures, however, typically have considerably poorer insulating properties and load-bearing capacity and it will often not be possible to open the panels as with regular roof windows.

It is therefore the object of the invention to allow the provision of a roof structure which combines the good insulating and structural properties achieved with groups of roof windows with the simpler structure and comparatively large light admitting area achieved with glass panel structures.

In a first aspect of the invention this is achieved with a connector bracket comprising a first connecting section configured for being connected to a mounting bracket on a first roof window and a second connecting section configured for being connected to a mounting bracket on a second roof window, where said first connecting section extends in a first direction from a centre section of the connector bracket and is configured for being connected to the mounting bracket on the first roof window in a pivot connection, where said second connecting section extends in a second direction from a centre section of the connector bracket and is configured for being connected to the mounting bracket on the second roof window in a fixed connection, and where said first and second directions are non-parallel.

This connector bracket is configured for interconnecting roof windows mounted one above the other in an inclined roof structure when seen in the direction of inclination. By allowing the connector bracket to interconnect mounting brackets on the two windows instead of connecting mounting brackets on each roof window separately to the roof structure in a traditional manner, the roof windows can be located closer to each other, thus allowing the light admitting area to be relatively bigger. Moreover, the distance in a direction perpendicular to the plane of the roof structure can be decreased.

One connecting section being configured for being connected to a mounting bracket in a pivot connection and the other being configured for a fixed connection to a mounting bracket contributes further to allowing the roof windows to be mounted close to each other. The pivot connection allows the connector bracket to swing, either for bringing the second connection section into engagement with the mounting bracket on the second roof window or for swinging the second roof window to which the connector bracket has already been connected into place.

The fact that the two connecting sections extend in non-parallel directions further contributes to a minimal distance between the windows by allowing one section to extend between the roof windows, while the other extends inwards or outwards along the frame of one of the roof windows, i.e. either towards the interior of the building cover by the roof structure or towards the exterior. It may also allow the section extending between the windows to reach over a beam or a like element of the load-bearing structure of the roof structure of the building. Moreover, the angled shape provides strength and stiffness to the connector bracket and thus to the roof window arrangement made with the connector bracket and thus allows the use of a comparatively smaller connector bracket.

The side of the connector bracket facing the interior of the building in the mounted state is preferably concave, in other words the angle between the first and second sections on the side of the connector bracket facing the interior of the building in the mounted state is less than 180 degrees.

If the second leg projects towards the exterior of the building, the side of the connector bracket facing the exterior of the building in the mounted state is preferably concave, in other words the angle between the first and second sections on the side of the connector bracket facing the exterior of the building in the mounted state is less than 180 degrees.

Using a connector bracket, which is concave towards the interior is presently preferred as it allows an optimal transmission of forces from especially the second roof window to the load-bearing structure. Thus is allows for the use of a relatively small connector bracket, which does not take up much space and which can be produced using a limited amount of material.

In a preferred embodiment the width of the first and/or second connecting sections in the plane defined by the first and second directions decreases with the distance from the centre section, the first and second sections for example having a tapered and rounded shape so that the overall shape of the connector bracket resembles that of a boomerang.

It is presently preferred that the first and second directions extend at an angle of 60-150 degrees in relation to each other, but the most expedient angle depends on several factors such as the angle of inclination of the roof structure and the design of the mounting brackets and of the roof structure. An angle of 110-120 degrees is presently considered advantageous for connecting both roof windows to a single load-bearing beam extending in a third direction extending perpendicular to the first and second directions.

In one embodiment of the connector bracket at least the first and second connecting sections are plate shaped with the smallest dimension of the plate extending in a third direction extending perpendicular to the first and second directions. In this way the connector bracket takes up as little space as possible while still having a high strength in the plane defined by the first and second directions. Roof windows mounted in a group usually do not give rise to high loads in directions perpendicular to the plane defined by the first and second direction, but the connector bracket must of course be able to endure some torsional forces. The necessary thickness will depend on the overall design of the connector bracket and the material chosen and may be determined by simple experiments. It is presently considered advantageous to make the connector bracket from stainless steel.

In one embodiment, the first connecting section and the second connecting section are off-set in relation to each other in a third direction extending perpendicular to the first and second directions. This allows the two connecting sections to be connected to items, which are not arranged in parallel or to opposite sides of such items as will be described in further detail below. For use in roof window arrangements made with standard roof windows the distance between the first and second connecting sections in the third direction is presently preferred to be 10-100 mm, preferably 20-50 mm.

The pivot connection between the first connecting section and the mounting bracket on the first roof window may be established in many ways, but simple pin or bolt connections where the pin or bolt define the axis of rotation are presently considered advantageous. In one embodiment the first connecting section therefore includes an opening adapted for receiving a fastening member, such as a pin or bolt. If the opening is elongate it will allow a slack between the fastening member and the connector bracket, which may be advantageous in connection with the mounting process, and which may also compensate for small irregularities and variations.

The connector bracket may further include a third connecting section adapted for being connected to a supporting element of a flashing assembly. The third connecting section will typically project from the centre section in a fourth direction, which extend substantially in the same plane as the first and section directions. It may include openings, projections and/or the like configured for engagement with the supporting element as will be described in further detail below, but the supporting element may also simply ride on the third connecting section.

In a second aspect of the invention the object of the invention is achieved with a roof window arrangement for use in an inclined roof structure including at least two roof windows, where one roof window is located below the other roof window when seen in the direction of inclination of the roof structure, and where the two roof windows are interconnected by a connector bracket as described above.

The roof window arrangement may further include a mounting shoe on the mounting bracket on the first roof window, said mounting shoe being adapted for resting on a load-bearing structure of the roof structure, where the first connecting section of the connector bracket is connected to the shoe in a pivot connection. By connecting the connector bracket to the mounting shoe the loads on the first window may potentially be reduced.

In one embodiment the mounting shoe is located between the mounting bracket on the first roof window and the first connecting section of the connector bracket. In this way the connection is gravitationally balanced as the loads from the two roof windows act on opposite sides of the mounting shoe.

The mounting bracket on the first roof window, the mounting shoe, and the first connecting section of the connector bracket can be interconnected by a pin or bolt extending through aligned openings in all three. This makes the connection structurally simple and relatively easy to establish.

In a third aspect of the invention the object of the invention is achieved with a method for mounting at least two roof windows in an inclined roof structure, one below the other when seen in the direction of inclination of the roof structure, where a first connecting section of a connector bracket is connected to a mounting bracket on a first roof window in a pivot connection and a second connecting section of the connector bracket is connected to a mounting bracket on a second roof window in a fixed connection, said first connecting section extending in a first direction from a centre section of the connector bracket and said second connecting section extending in a second direction from a centre section of the connector bracket, and said first and second directions being non-parallel. As described above with reference to the connector bracket and the roof window arrangement, this provides a structurally simple construction which is optimized with respect to transmitting loads from the roof windows to the load-bearing structure of the roof structure.

Embodiments and advantages described with reference to one aspect of the invention also applies to the other aspects unless otherwise stated.

Figure 2:
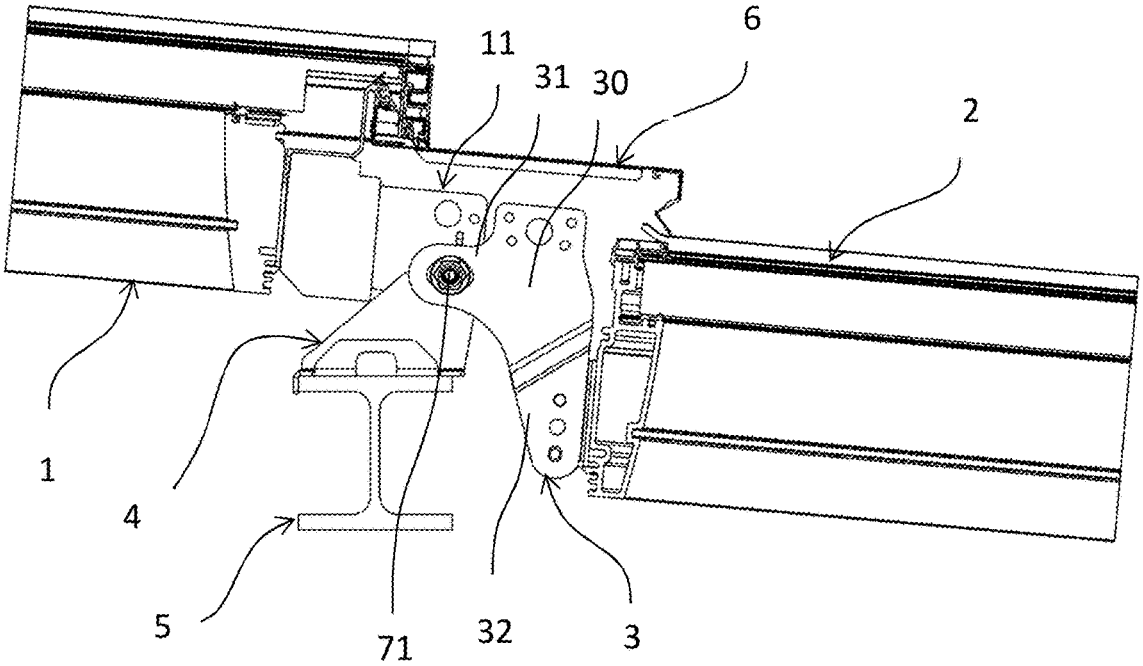
Figure 3:
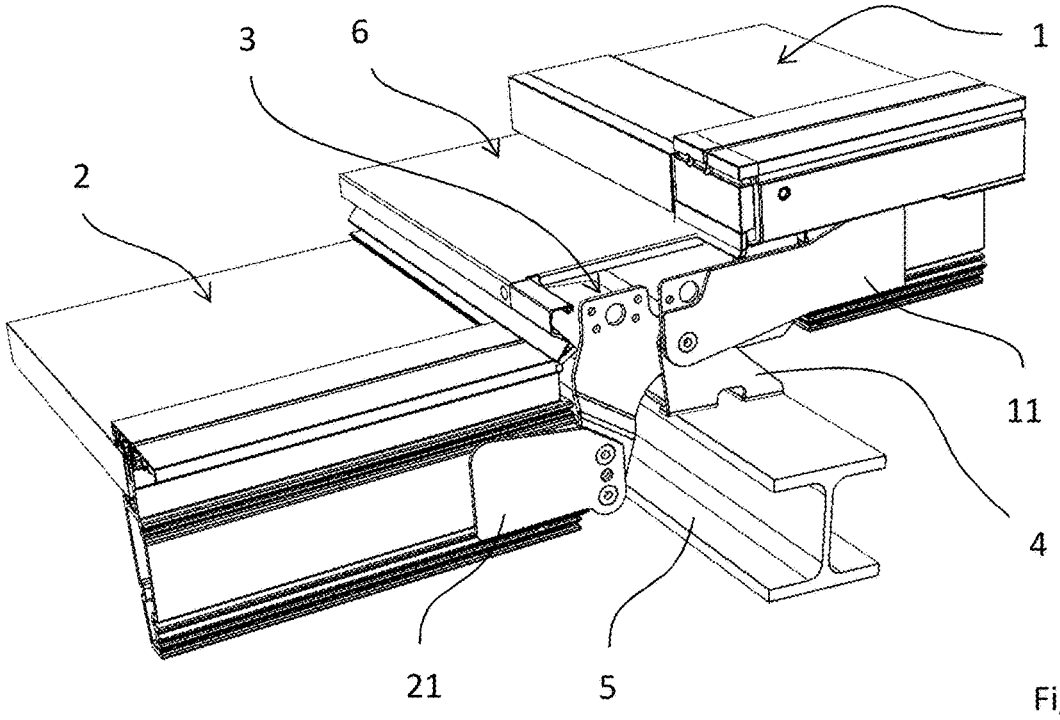
Figure 4:
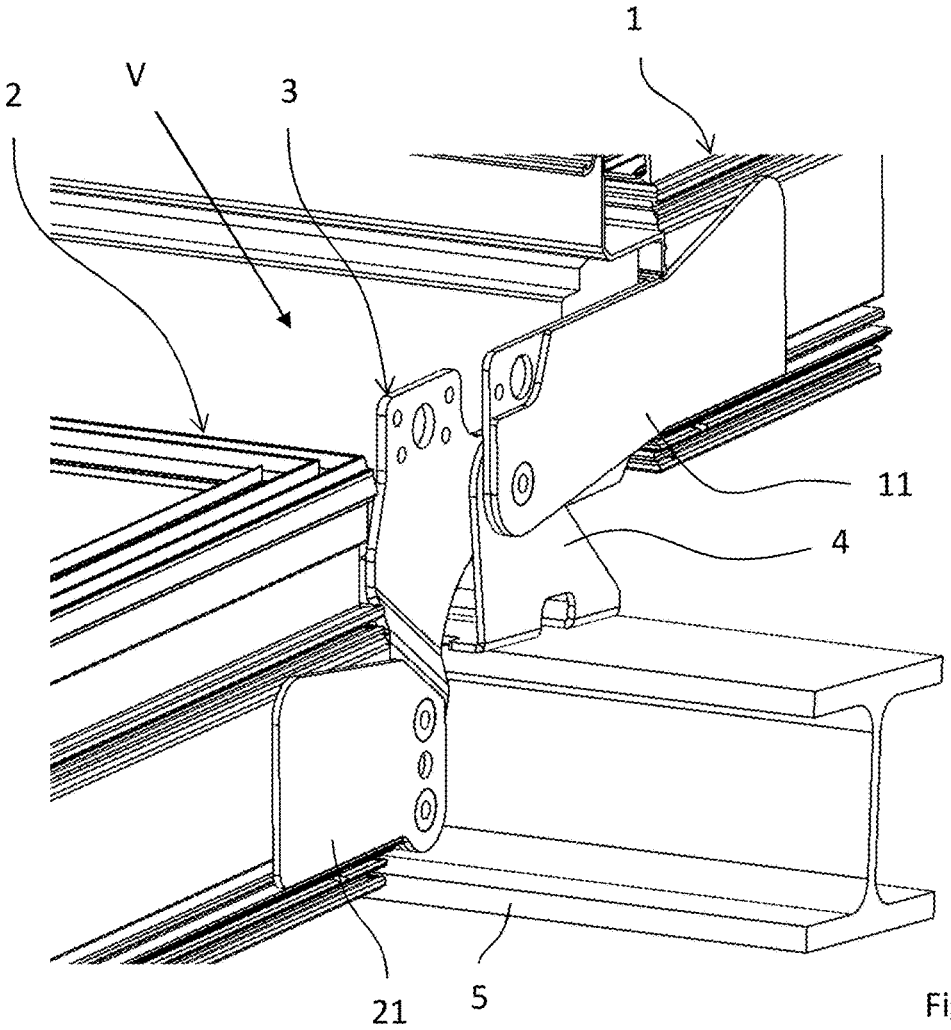
Figure 5:
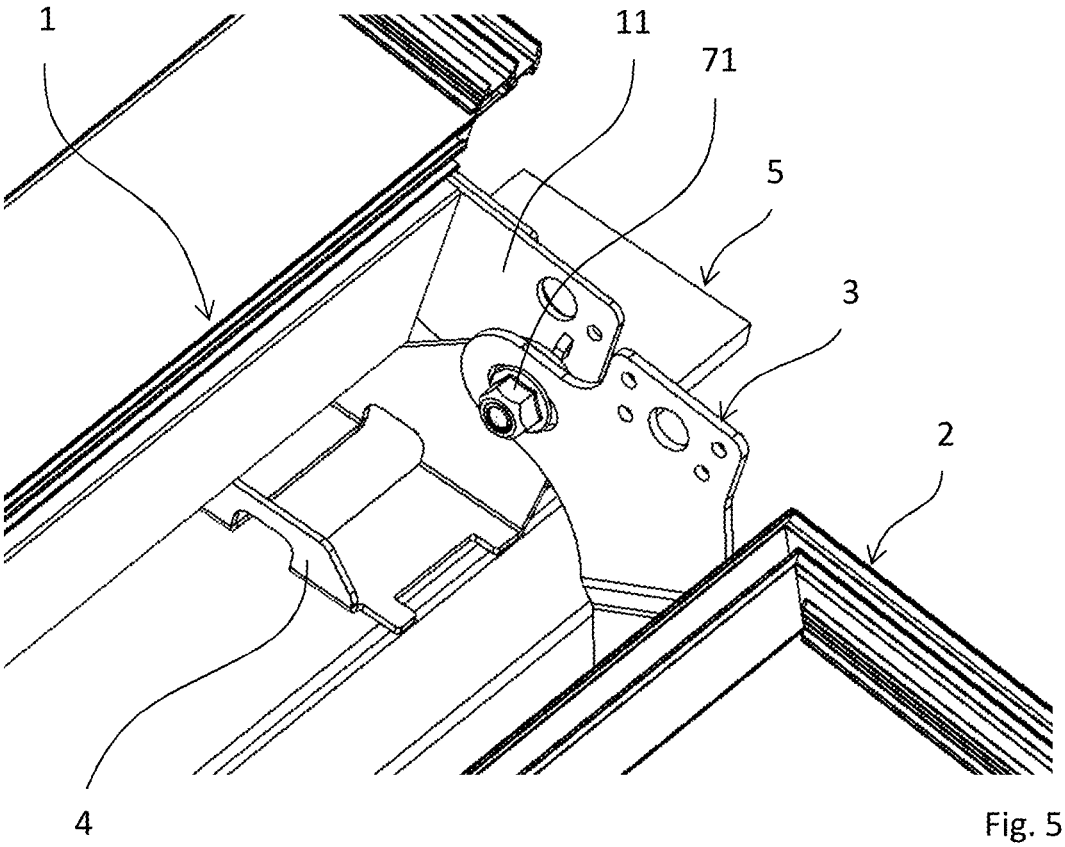
Figure 6:
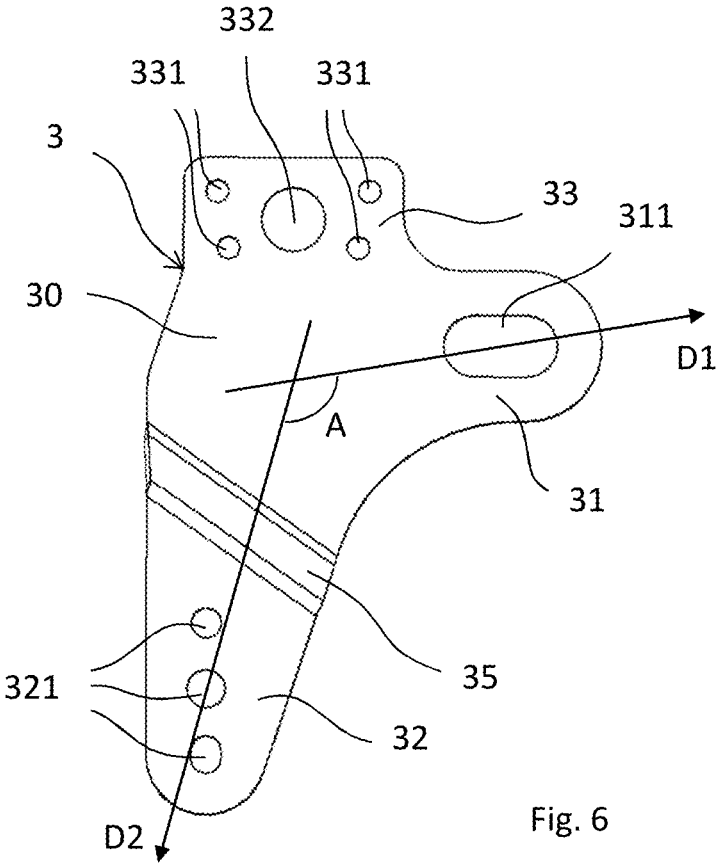
Figure 7:
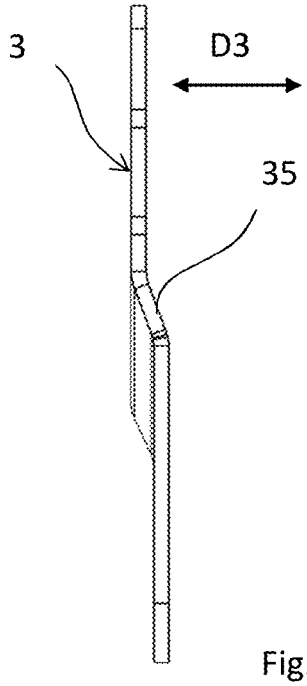
Figure 8:
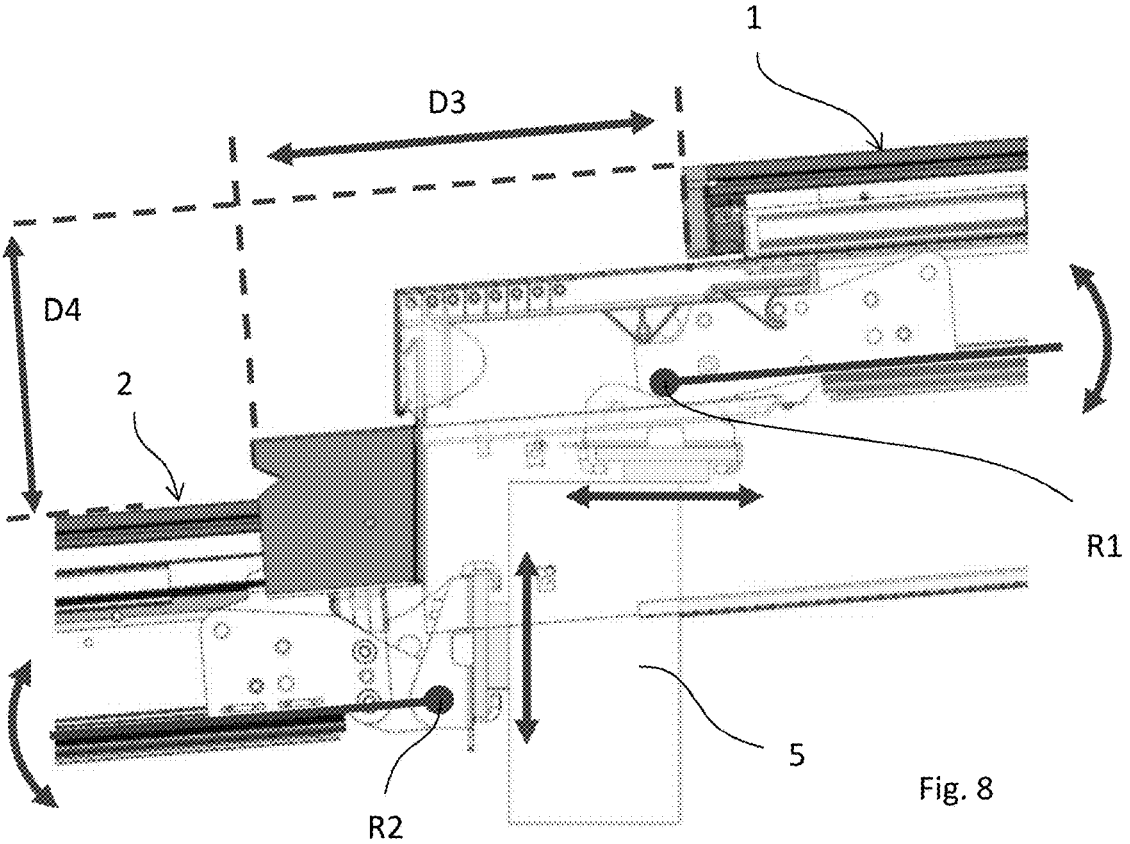
Figure 9:
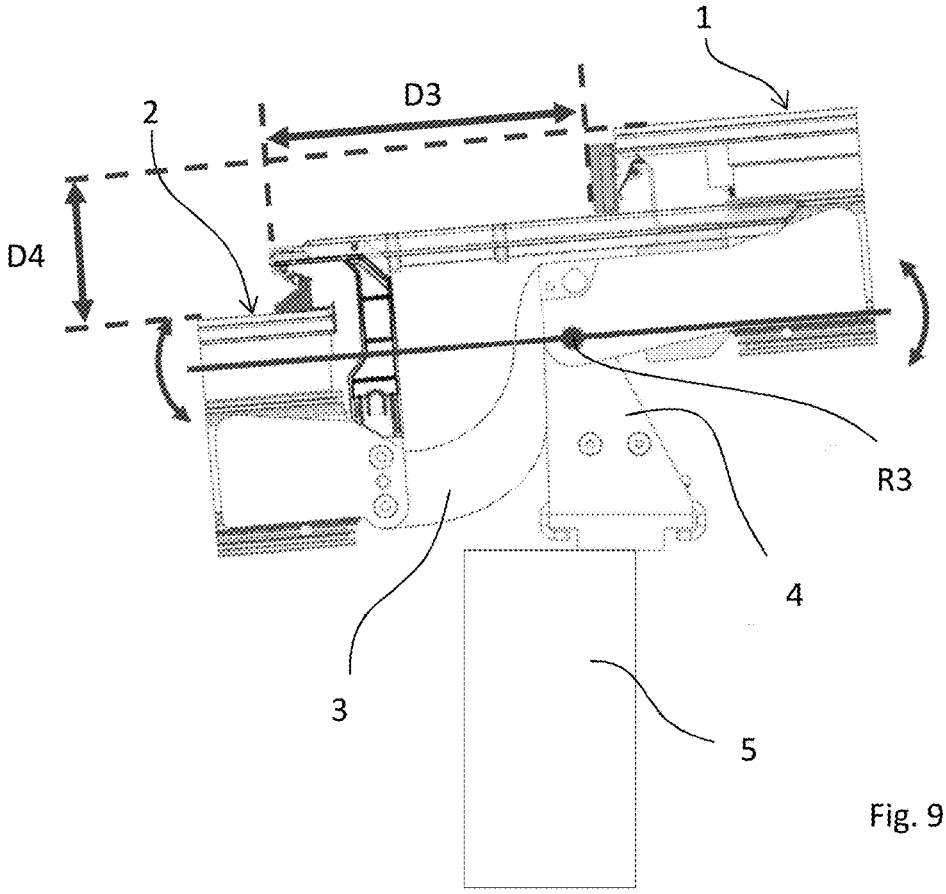
Figure 10:
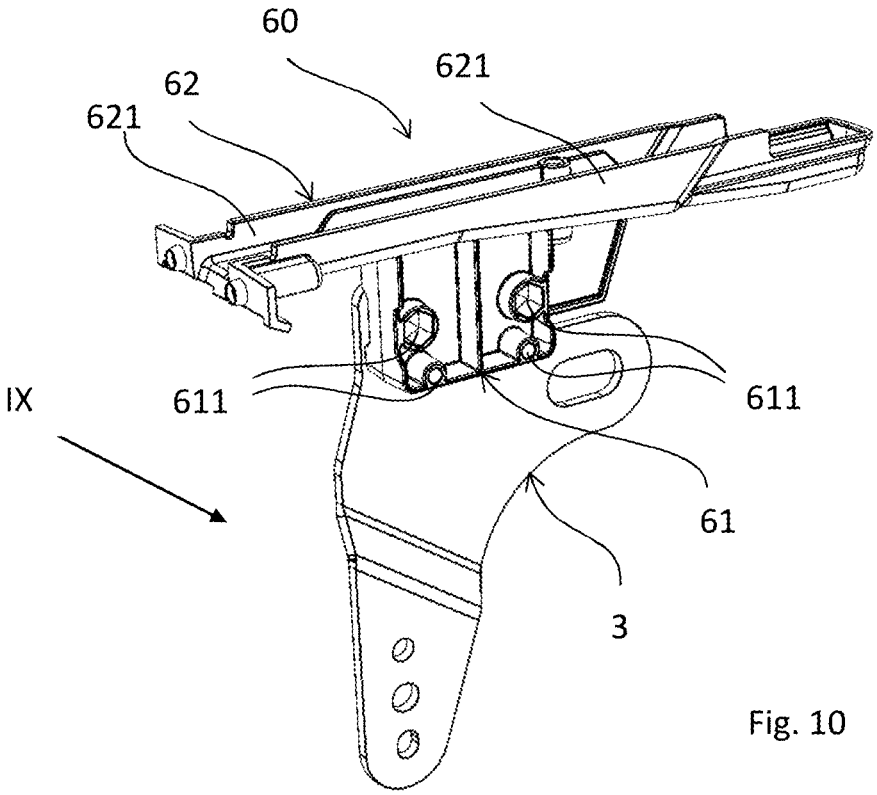
Figure 11:
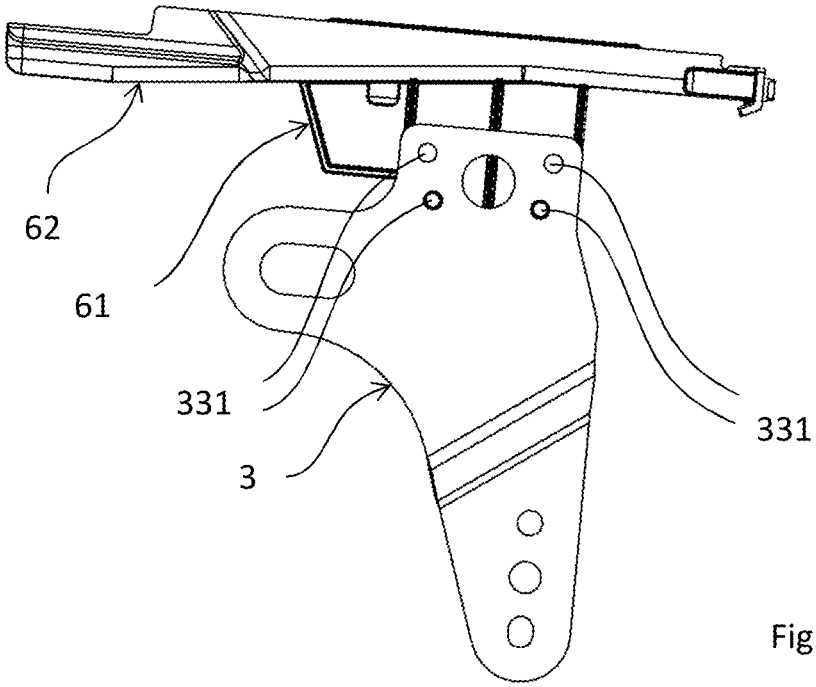
Figure 12:
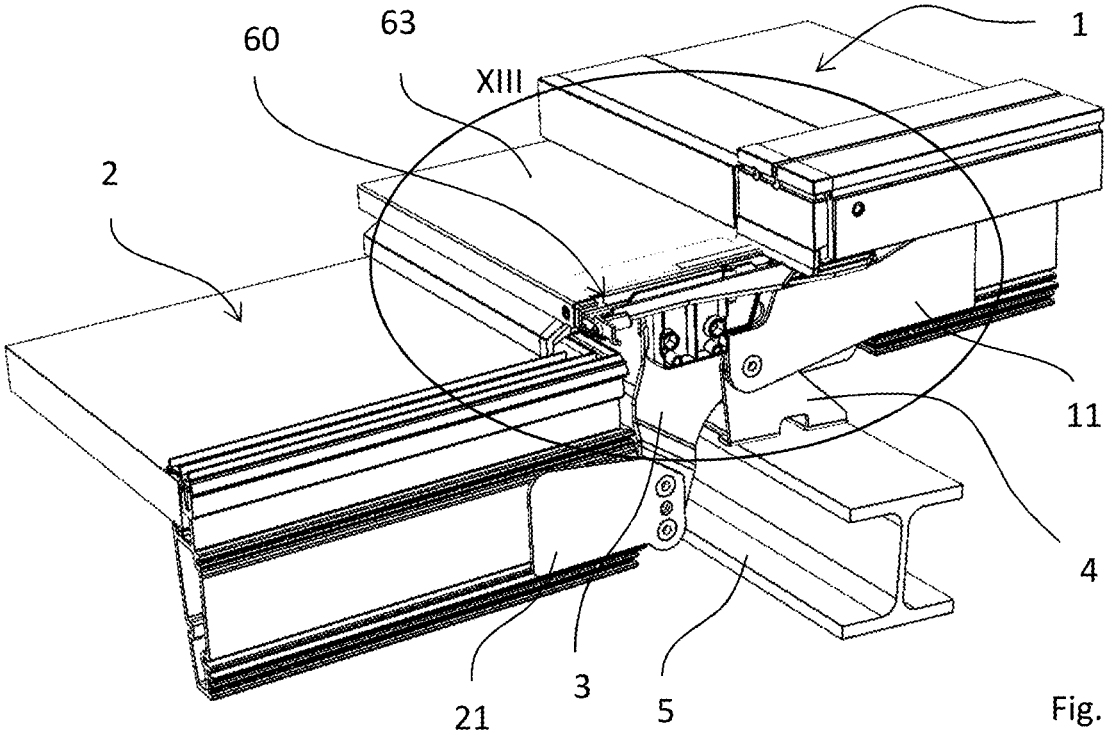
Figure 13:
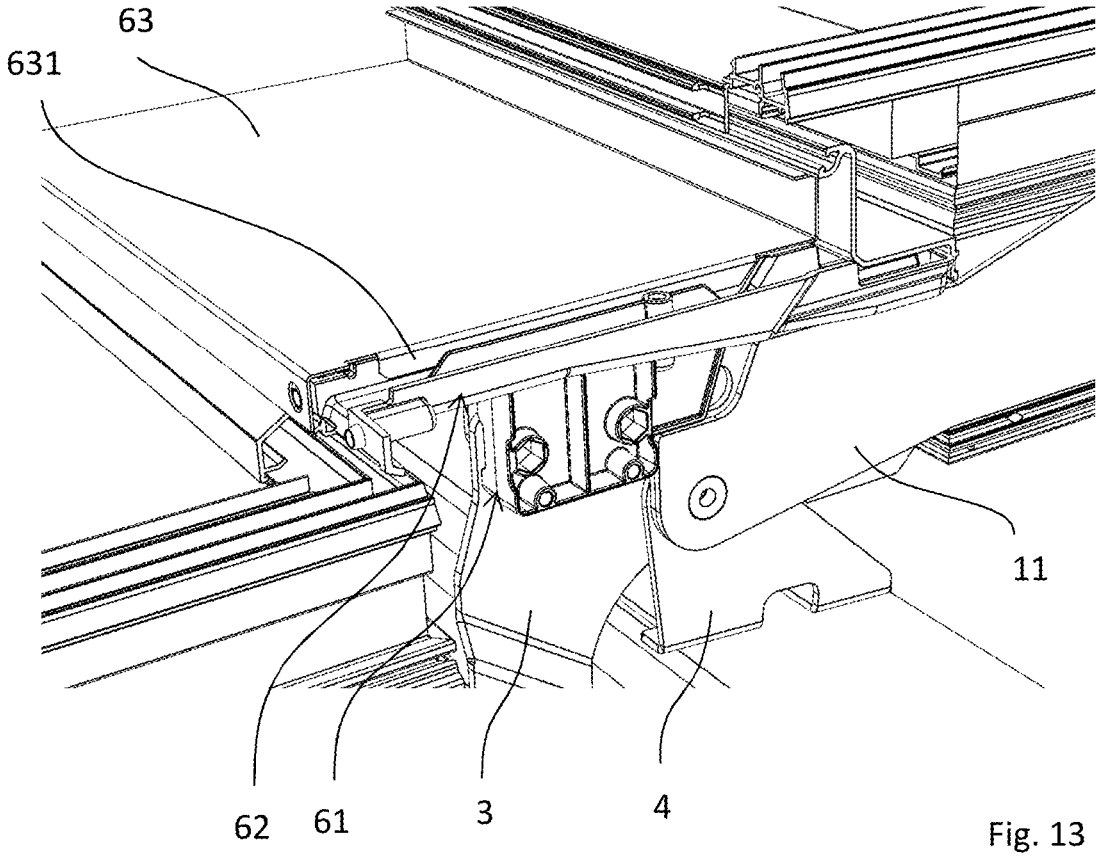

In the following the invention will be described in further detail with reference to non-limiting embodiments shown in the drawing, where:

FIG. 1 is a partially cut-away side-view of a roof window arrangement according to the invention, FIG. 2 is a partially cut-away cross-sectional view of the roof window arrangement in FIG. 1 seen from the opposite side, FIG. 3 is a partially cut-away perspective view of the roof window arrangement in FIGS. 1 and 2, FIG. 4 is another partially cut-away perspective view of the roof window arrangement in FIGS. 1-3, where the flashing assembly has been removed, FIG. 5 corresponds to FIG. 4 but seen from the angle indicated by the arrow V in FIG. 4, FIG. 6 is a side-view of a connector bracket according to the invention, FIG. 7 is an end-view of the connector bracket in FIG. 6, FIG. 8 is a partially cut-away cross-sectional view of a prior art roof window arrangement, FIG. 9 is a partially cut-away cross-sectional view corresponding to FIG. 8, but showing a roof window arrangement according to the invention, FIG. 10 is a perspective view of a connector bracket with a supporting element for a flashing assembly mounted thereon, FIG. 11 is a side-view of the connector bracket and supporting element in FIG. 10 seen from the direction indicated by the arrow IX in FIG. 10, FIG. 12 is a partially cut-away perspective view of the window arrangement corresponding to FIG. 3 but including the supporting element shown in FIGS. 10 and 11, and FIG. 13 is a close-up of the detail marked XIII in FIG. 12 with parts of the flashing assembly removed.

A window arrangement according to the invention is shown in FIGS. 1-5. It includes a first roof window 1, a second roof window 2, a connector bracket 3, and a mounting shoe 4 resting on a load-bearing structure of an inclined roof-structure, here represented by an I-beam 5. The window arrangement further includes a flashing assembly generally designated 6.

The first roof window 1, which is here the uppermost when seen in the direction of inclination of the roof structure, includes a mounting bracket 11, which is connected to the mounting shoe 4 and to a first connecting section 31 the connector bracket 3 in a pivot connection 71, here represented as a bolt extending through aligned openings in the mounting bracket, the mounting shoe, and the first connecting section.

The second roof window 2, which is here the lowermost when seen in the direction of inclination of the roof structure, includes a mounting bracket 21, which is connected to a second connecting section 32 of the connector bracket 3 in a fixed connection, here represented as two pins 72 extending through aligned openings in the mounting bracket and the second connecting section.

In other embodiments the first roof window 1 may be lowermost and the second roof window 2 uppermost in the mounted state.

As is seen by comparing FIG. 8 and FIG. 9 the use of a connector bracket 3 according to the invention means that the two roof windows 1, 2 mounted one above the other rotate about the same point of rotation R3, whereas the two windows of the prior art roof window arrangement rotate about different points R1 and R2. This difference entails that loads from both roof windows in the roof window arrangement in FIG. 9 can be transferred to one mounting shoe 4 on the load-bearing beam 5, thus potentially allowing a simpler load-bearing structure. Moreover, it means that both the distance D3 between the windows in the parallel with the plane of the roof structure, and the distance D4 between the exterior sides of the panes of the two roof windows can be decreased. This both saves space, increases the relative light admitting area, and allows a minimalistic visual appearance of the roof window arrangement, which is often preferred in modern architecture.

The connector bracket 3 in FIG. 9 is shown as being convex on the side facing the exterior of the building in the mounted state, whereas the connector brackets in the other figures are concave towards the interior as is presently preferred.

The openings in the connector bracket 3 used for establishing the connection with the mounting brackets 11,21 and the mounting shoe 4 are seen clearly in FIG. 6, which shows the connector bracket from the same side as in FIG. 1. Opening 311 in the first connecting section 31 is elongate, which allows connector bracket to slide a little bit in relation to the bolt 71, thus allowing the connector bracket to both pivot in relation to the mounting bracket 11 on the first roof window and to accommodate smaller variations during mounting. The openings 321 in the second connecting section 32, of which only two are used in the embodiment of the roof window arrangement shown, are circular as they are configured to establish a fixed connection to the mounting bracket 21 on the second roof window.

As is also best seen in FIG. 6 the first connecting section 31 extends in a first direction D1 from a centre section 30 of the connector bracket 3 and the second connecting section 32 extends in a second direction D2 from the centre section, said first and second directions extending at an angle A in relation to each other.

The first and second directions D1, D2 are here defined as lines extending through the gravitational centre of the connector bracket and through the gravitational centre of the openings used for establishing the connection to the mounting brackets. If the connector bracket is without such openings and configured for being connected to the mounting brackets of the two roof windows in another way, such as for example by projections adapted for engaging with openings in the mounting brackets, the first and second directions are defined by lines extending through the gravitational centre of the connector bracket and through the centre of the connection with the respective mounting brackets.

In the embodiment shown in the drawing, the angle A between the first and second directions is 115 degrees. This angle allows the connector bracket 3 to extend down along the outer side of the frame of the second roof window, and to extend over the beam 5 of the load-bearing structure as is best seen in FIGS. 2 and 5, while still having sufficient surface area to possess the necessary strength. The rounded shapes of the first and second connecting sections 31, 32 ensures that there are no sharp corners, which might be dangerous to the installers mounting the roof windows, and further facilitates turning of connector bracket in relation to other items during mounting. Moreover, the stresses which tend to build up at sharp corners in a bracket is avoided.

This embodiment of the connector bracket 3 is plate shaped with the smallest dimension of the plate extending in a third direction D3 extending perpendicular to the first and second directions, i.e. in parallel to the bolt 71 and pins 72, as shown in FIG. 7. This means that the connections between the mounting brackets 11,21 and the connector bracket 3 have a limited extend in the third direction. Moreover, as the loads from the roof windows 1,2 act primarily in the plane defined by the first and second directions D1, D2, the plate shape ensures that the material of connector bracket is concentrated where it is most needed. A thicker bracket or a bracket having flanges extending in the third direction or other adaptations intended to increase its torsional strength is, however, within the scope of the invention.

As is also seen in FIG. 7 the second connecting section 32 of the connector bracket 3 is in this embodiment off-set in relation to the centre section 30 and the first connecting section 31 in the third direction D3 extending perpendicular to the first and second directions. This is achieved by the connector bracket being provided with an oblique section 35. In this embodiment the oblique section is formed simply by two bends on the plate material used for the connector bracket 3, but the connector bracket could also be formed from two pieces of material, which were interconnected to be arranged at a distance from each other. Likewise, reinforcement could be provided at the bends and/or at the oblique section.

At the top, the connector bracket in FIGS. 6 and 7 is provided with a third section 33 having openings 331 adapted for interconnection with a supporting element 60 of a flashing assembly 6 as it is shown in FIGS. 10 and 11. The opening 332 is intended to serve as a point of attachment where a crane or similar handling equipment can get a hold of the connector bracket during mounting, possibly when the connector bracket 3 is already connected to the second window.

As is seen in FIGS. 10 and 11 the openings 331 are adapted to align with similar openings 611 in a connecting section 61 of a supporting element 60 so that a fixed connection can be established as described with reference to the connection between the connector bracket 3 and the mounting bracket 21 on the second roof window 2 above.

The part 62 of the supporting element 60 which is uppermost in FIGS. 10 and 11 is gutter-shaped and the side flanges 621 defining the gutter are each intended to engage with a bent edge 631 of a flashing member 63 as shown for one of them in FIGS. 12 and 13. In the finished construction a further flashing member engages with the opposite side flange of the supporting element, but this has been left out to allow the supporting element to be seen. In this way the loads from the flashing member 63 covering the space between the first and the second roof window are transmitted at least partially to the connector bracket 3 and from there via the mounting shoe 4 to the load-bearing structure 5, thus minimizing the loads acting on the roof windows 1,2. Moreover, the fact that the supporting element 60 rests on the connector bracket 3 means that the mounting brackets 11, 21 on the roof windows do not have to be configured to carry the supporting element as has been the case in prior art roof window arrangements.

LIST OF REFERENCE NUMBERS

1 First roof window
11 Mounting bracket
2 Second roof window
21 Mounting bracket
3 Connector bracket
30 Centre section
31 First connecting section
311 Opening
32 Second connecting section
321 Opening
33 Third section
331 Openings
332 Openings
35 Oblique section
4 Mounting shoe
5 Load-bearing structure
6 Flashing assembly
60 Supporting element
61 Connecting section
611 Openings
62 Part of the supporting element
63 Flashing member
631 Bent edge
71 Pivot connection
72 Pins
A Angle
D1 Distance
2 Distance
D3 Distance
D4 Distance
R1 Point of rotation
R2 Point of rotation
R3 Point of rotation

The invention claimed is:

1. A connector bracket for interconnecting roof windows mounted adjacent to each other in an inclined roof structure, one roof window being located below another roof window when seen in a direction of inclination of the inclined roof structure, wherein said connector bracket comprises a first connecting section and a second connecting section wherein when said connector bracket is installed in an operating position said first connecting section is connected to a mounting bracket on a first roof window and said second connecting section is connected to a mounting bracket on a second roof window and wherein said connector bracket is a single piece and said first roof window extends in a first length direction and said second roof window extends in a second length direction, said first length direction is substantially parallel to said second length direction, said first connecting section extends in a first direction from a centre section of the connector bracket and is configured for being connected to the mounting bracket on the first roof window in a pivot connection, said second connecting section extends in a second direction from a centre section of the connector bracket and is connected to the mounting bracket on the frame of the second roof window in a fixed connection, and said first and second directions are non-parallel.

2. The connector bracket according to claim 1, where said first and second directions extend at an angle of 60-150 degrees in relation to each other.

3. The connector bracket according to claim 2, where said first and second directions extend at an angle of 110-120 degrees in relation to each other.

4. The connector bracket according to claim 2, where at least the first and second connecting sections are plate shaped with the smallest dimension of the plate extending in a third direction extending perpendicular to the first and second directions.

5. The connector bracket according to claim 1, where at least the first and second connecting sections are plate shaped with the smallest dimension of the plate extending in a third direction extending perpendicular to the first and second directions.

6. The connector bracket according to claim 5, where the first connecting section and the second connecting section are off-set in relation to each other in a third direction extending perpendicular to the first and second directions.

7. The connector bracket according to claim 6, where the distance between the first and second connecting sections in the third direction is 10-100 mm.

8. The connector bracket according to claim 1, where the first connecting section and the second connecting section are off-set in relation to each other in a third direction extending perpendicular to the first and second directions.

9. The connector bracket according to claim 8, where the distance between the first and second connecting sections in the third direction is 10-100 mm.

10. The connector bracket according to claim 8, where the distance between the first and second connecting sections in the third direction is 20-50 mm.

11. The connector bracket according to claim 1, where the first connecting section includes an opening adapted for receiving a fastening member, wherein the fastening member is one of a pin or bolt.

12. The connector bracket according to claim 11, where said opening is an elongated opening.

13. The connector bracket according to claim 12, further including a third connecting section adapted for being connected to a supporting element of a flashing assembly.

14. The connector bracket according to claim 1, further including a third connecting section adapted for being connected to a supporting element of a flashing assembly.

15. A roof window arrangement for use in an inclined roof structure including at least two roof windows, where a first roof window is located below a second roof window when seen in a direction of inclination of the inclined roof structure, and where the first and second roof windows are interconnected by a connector bracket wherein said connector bracket comprises a first connecting section and a second connecting section wherein said connector bracket is configured such that said second connecting section does not move relative to said first connecting section and wherein when said connector bracket is installed in an operating position said first connecting section is connected to a mounting bracket on the first roof window and said second connecting section is connected to a mounting bracket on the second roof window and wherein said first roof window extends in a first length direction and said second roof window extends in a second length direction, said first length direction is substantially parallel to said second length direction, said first connecting section extends in a first direction from a centre section of the connector bracket and is configured for being connected to the mounting bracket on the first roof window in a pivot connection, said second connecting section extends in a second direction from a centre section of the connector bracket and is connected to the mounting bracket on the second roof window in a fixed connection, and said first and second directions are non-parallel.

16. The roof window arrangement according to claim 15, further including a mounting shoe on the mounting bracket on the first roof window, said mounting shoe being adapted for resting on a load-bearing structure of the roof structure, and where the first connecting section of the connector bracket is connected to the shoe in a pivot connection.

17. The roof window arrangement according to claim 16, where the mounting shoe is located between the mounting bracket on the first roof window and the first connecting section of the connector bracket.

18. The roof window arrangement according to claim 17, where the mounting bracket on the first roof window, the mounting shoe, and the first connecting section of the connector bracket are interconnected by a pin or bolt extending through aligned openings therein.

19. The roof window arrangement according to claim 16, where the mounting bracket on the first roof window, the mounting shoe, and the first connecting section of the connector bracket are interconnected by a pin or bolt extending through aligned openings therein.

20. A method for mounting at least two roof windows in an inclined roof structure, one below another when seen in a direction of inclination of the inclined roof structure, comprising the steps of:

providing a first connecting section of a connector bracket connected to a mounting bracket on a first roof window in a pivot connection;

providing a second connecting section of the connector bracket connected to a mounting bracket on a second roof window in a fixed connection, said first connecting section extending in a first direction from a centre section of the connector bracket and said second connecting section extending in a second direction from a centre section of the connector bracket, and said first and second directions being non-parallel and wherein said first roof window extends in a first length direction and said second roof window extends in a second length direction, said first length direction is substantially parallel to said second length direction; and, forming said connector bracket such that said first connecting section does not move relative to said second connection section.

* * * * *